US005352062A

United States Patent [19]

Yoshida et al.

[11] Patent Number: 5,352,062

[45] Date of Patent: Oct. 4, 1994

[54] SKID ROAD SURFACE AND METHOD FOR CONSTRUCTING SAME

[75] Inventors: Tyuzo Yoshida, Ichikawa; Masao Watanabe, Kasukabe; Tuyoshi Satoh, Sendai; Takao Arai, Sayama; Tetsuya Shimoda, Hachioji, all of Japan

[73] Assignee: Nippon Hodo Company, Limited, Tokyo, Japan

[21] Appl. No.: 944,822

[22] Filed: Sep. 14, 1992

[30] Foreign Application Priority Data

Sep. 13, 1991 [JP] Japan ..... 3-308582
Sep. 13, 1991 [JP] Japan ..... 3-308583

[51] Int. Cl.[5] ..... E01C 9/00; E01C 21/00
[52] U.S. Cl. ..... 404/17; 404/72
[58] Field of Search ..... 404/17, 72, 82

[56] References Cited

U.S. PATENT DOCUMENTS

| | | | |
|---|---|---|---|
| 299,924 | 6/1884 | Harkins | 404/82 |
| 1,915,814 | 6/1933 | Mason et al. | 404/82 |
| 2,555,078 | 5/1951 | Gaylor | 404/17 |

*Primary Examiner*—Mark Rosenbaum
*Assistant Examiner*—John M. Husar
*Attorney, Agent, or Firm*—Scully, Scott, Murphy & Presser

[57] ABSTRACT

A road surface specially designed to enhance skidding includes an asphalt mixture containing a plurality of substantially spherical coarse aggregates, said aggregates having a randomly continuous shape on their upper surface. A method to provide this surface involves replacing a road having an asphalt coating with the road surface of the present invention.

20 Claims, No Drawings

SKID ROAD SURFACE AND METHOD FOR CONSTRUCTING SAME

BACKGROUND OF THE INVENTION

The present invention relates to a skid (or sliding) road surface capable of providing a stable, low skid resistance value and a method for constructing the same.

Recently, also in driving schools, there has been an increasing necessity of providing a skid road surface in driving test roads, driving schools and the like. For example, some driving schools have a skid experiencing road to let the students acquire a careful driving technique.

Heretofore, cement concrete type and asphalt concrete type skid road surfaces have been used practically. In many of asphalt concrete type skid road surfaces, an asphalt mixture using limestone as a coarse aggregate is used to pave a road surface and the thus-paved surface is then ground for smoothing.

In using the resultant skid road surface, water is sprinkled over the road surface so as to give a uniform thickness of water layer throughout the road surface and in this wet state the skidding road surface is used for running of an automobile thereon. Thus, during vehicular running, the asphalt concrete pavement is kept soaked in water, so that the surface of the limestone exposed to the surface of the pavement is covered with the sprinkled water and the surface lime of the limestone is dissolved out with the water.

Further, the dust between the vehicular tires and the road surface causes wear of the surface limestone of the pavement.

Due to these matters, the limestone surface which was initially ground smooth becomes more and more uneven and the skid resistance increases with the lapse of time. According to the prior art, for maintaining a certain resistance value, grinding is repeated periodically or is performed upon increase of the skid resistance value, but these maintenance works require much labor and expenses.

It is the object of the present invention to eliminate the aforementioned conventional drawbacks of an asphalt concrete type skid road surface using an asphalt mixture and provide a pavement surface having a stable, low skid resistance value and not causing a secular change, as well as a method for constructing the same and an asphalt mixture suitable for the same.

SUMMARY OF THE INVENTION

As asphalt concrete type skid road surface according to the present invention employs a substantially spherical coarse aggregate as a coarse aggregate contained in an asphalt mixture which is used for constructing the said skid road surface, and the pavement surface formed according to the present invention is characterized by having a randomly continuous shape based on the upper surface shape of the coarse aggregate.

DETAILED DESCRIPTION OF THE INVENTION

The coarse aggregate used in the present invention can be considered substantially spherical in practical use and is essentially not limited if only the surface thereof is difficult to be flawed and has a hardness not causing wear and flattening during the use thereof as a skid road surface and during vehicular running thereon. For example, artificial or natural gravel is used as the coarse aggregate. Natural pebbles are particularly preferred. Characteristics which such spherical coarse aggregate should possess will now be described in more particular terms. When the tires of an automobile come into contact with the skidding road surface during running of the automobile thereon, the surface of the spherical coarse aggregate should be difficult to be flawed, have a hardness of 6% or less, preferably 3% or less, in terms of abrasion loss as measured by a Dobal tester, also should have an indoor PSV of 45 BPN or less, preferably 40 BPN or less, as measured by an aggregate accelerated abrasion test according to the BS standard which value indicates easier skidding of automobile tires during running of the automobile, further should have a difference of 4 or less between the value obtained before the aggregate accelerated abrasion test according to the BS standard and the value obtained after the same test which difference indicates the difficulty of change in skid during continuous running of an automobile on the skidding road surface, and preferably it is difficult to change according to weather conditions and has a skid resistance value of ±4 BPN (as measured using a portable skid resistance tester) after a weathering test (conducted 400 hours using a sunshine weather meter) involving repeated radiation of ultraviolet ray and sprinkling of water, with respect to a skid resistance value obtained before the same test.

Although the size of the coarse aggregate is not specially limited, the diameter thereof in the paved surfaces formed preferably corresponds to a large coarse aggregate diameter of 20 to 5 mm in the paved asphalt concrete surface course of a general road. There may be used only one kind, or two or more kinds in combination, out of those classified within the above range.

It is preferable that the coarse aggregate grains be present adjacent to each other without interruption when the asphalt mixture is used for pavement. The coarse aggregate is used in an amount of usually 50 to 90 wt %, preferably 60 to 80 wt %, based on the weight of the entire asphalt mixture.

In the asphalt mixture there also is contained a fine aggregate together with the above coarse aggregate. As the fine aggregate, sand is used at least as a main portion thereof. Both natural sand and screenings are employable if only they can be converted to asphalt mortar in the asphalt mixture. Particularly when the proportion of screenings is sand is in the range of 25 to 75 wt %, the resulting asphalt mixture is easily compacted and stable and grasps the spherical coarse aggregate well. It is necessary to keep the amount of sand within range in which the shape of the resulting pavement surface is not flat and there appear random protuberanes (partially spherical) based on the spherical coarse aggregate. Preferably, sand is used in an amount such that an average texture depth is about 1/10 to 1/20 of the maximum grain diameter of the coarse aggregate. Usually, sand is used in an amount of 15 to 30 wt %, preferably 20 to 25 wt %, based on the weight of the entire asphalt mixture. Further, stone dust is used as a filler. Preferably, stone dust is used in an amount of 1 to 8 wt %. Particularly, when a portion thereof is replaced with slaked lime, there is obtained a more outstanding effect. It is preferable that slaked lime be used in an amount of 1 to 3 wt %. As the asphalt component there is used asphalt which is commonly used for pavement. Particularly preferred is one containing an elastomer such as SBR. The elastomer content of the asphalt is preferably in the range of 1 to 10 wt %. Usually, the proportion of the asphalt component is in the range of 3 to 6 wt % of the entire mixture.

For example, the surface course of an existing road cut out and the asphalt mixture is applied for pavement to form a skid road surface. The pavement surface thus obtained is employable as a skid road surface if it assumes a shape comprising random protuberances (partially spherical) which are continuous and based on the spherical coarse aggregate. It is more desirable to remove the asphalt mortar from the pavement surface to expose the coarse aggregate surface now free of the asphalt coating.

Thus, the present invention is also concerned with a method for constructing a skid road surface characterized in that, in asphalt concrete pavement, a substantially spherical coarse aggregate is used as a coarse aggregate contained in an asphalt mixture of the surface course, and an asphalt coating on the coarse aggregate present in the pavement surface portion is removed.

It is also possible to use a coarse aggregate having a dihedral angle, as will be described later, then remove the asphalt mortar from the resulting pavement surface and at the same time grind the exposed dihedral angle portion of the coarse aggregate to round it. This mode of embodiment is also included in the present invention.

By thus removing the asphalt mortar from the resulting pavement surface, the coarse aggregate surface now free of the asphalt coating is exposed to obtain a surface shape comprising random protuberances (partially spherical) which are continuous and based on the spherical coarse aggregate.

Usually, if the thus-paved road is allowed to stand or seldom used, the asphalt mixture exhibits an increase in skid resistance with the lapse of time. This is an aging phenomenon of asphalt concrete pavement. As a result of a weathering test it turned out that this phenomenon was caused by the loss of oil component from the asphalt contained in the asphalt mortar present in the pavement surface under such weather conditions as dry-wet repetition, repetition of shining, and hot-cold repetition. On the other hand, by exposing the coarse aggregate surface as described above it is made possible to prevent the increase of skid resistance and obtain a skidding road surface superior in performance. Further, by grinding this coarse aggregate surface it is made possible to obtain a lower skid resistance and maintain it.

The method for removing the asphalt coating is not specially limited.

For example, there may be adopted a method of heating the pavement surface to soften and remove the asphalt mortar, a method of spraying a gas oil or a solvent over the pavement surface to cut back the asphalt mortar and removing the softened asphalt mortars, or a method using water jet, shot blasting or sand blasting. The method using water jet will now be described as an example. The pressure of water to be jetted is not specially limited only it permits removing of the asphalt mortar from the pavement surface. But since a distance is needed between the road surface and the discharge port, it is preferable that the said pressure be not lower than 300 kg/cm$^2$. Further, the asphalt mortar removing operation can be done more efficiently by rotating plural discharge ports. Usually, the asphalt coating slightly remains on the coarse aggregate surface after removal of the asphalt mortar, but it can be removed easily with running of an automobile thereon, whereby there can be attained a low skid resistance. Where a low skid resistance value is to be obtained simultaneously with completion of the execution of work, this can be attained, for example, by dissolving an abrasive powder 4 to 10 $\mu$m in diameter in water, then applying it to the road surface after removal of the asphalt mortar and grinding the road surface with a nylon pad or the like.

In the case of shot blasting for removal of the asphalt mortar, the steel shot diameter is not specially limited if only it permits removal of the asphalt mortar from the pavement surface, but preferably it is in the range of 0.3 to 2.5 mm.

The shape thereof may be spherical or a shape having a dihedral angle provided it permits removal of the asphalt mortar. The quantity of steel shots to be used is not specially limited if only the asphalt mortar can be removed without influence of the machine moving speed upon the grinding work of the next step; for example, it is preferably in the range of 150 to 240 kg per minute at a machine moving speed of 5 to 15 m per minute.

In the case of sand blasting, the sand diameter is not specially limited if only the asphalt mortar can be removed from the pavement surface, but preferably it is in the range of 0.6 to 2 mm. The shape of sand to be used may be spherical or one having a dihedral angle provided it permits removal of the asphalt mortar. Preferably, a shape having a dihedral angle is used. The quantity of sand to be used is not specially limited if only it permits removal of the asphalt mortar, but a quantity thereof which permits efficient recovery of the sand after use is preferred, e.g. 20–30 kg/m$^2$.

In the case where shot blasting is applied to an asphalt concrete pavement surface using a coarse aggregate having a hardness of 15% or less as measured in a Los Angeles abrasion loss test for evaluating the hardness of crushed stone for road, the coarse aggregate surface exposed is rough and a considerable time is required for grinding to obtain a low skid resistance. For efficient execution of the said method, for example, shot blasting is again performed using steel shots of 0.3 to 0.6 mm in diameter, or sand blasting is conducted again.

The method for grinding after removal of the asphalt mortar is not specially limited if only a low skid resistance value is obtained thereby. For example, according to a method which is often adopted, an abrasive powder 4 to 10 $\mu$m in diameter is dissolved in water, then applied to the road surface after removal of the asphalt mortar, followed by grinding using a nylon pad.

According to the present invention, the conventional drawbacks of a skid road surface constructed of asphalt concrete using an asphalt mixture can be eliminated and it becomes possible to provide a stable skidding road surface not causing a secular change of a skid resistance value under any conditions of use or weather conditions, whereby the maintenance work for maintaining the skid resistance value or properties after pavement is not required, thus permitting a great contribution to economy.

EXAMPLE

Asphalt mixtures shown in Table 1 were prepared each using asphalt, coarse aggregate, sand and stone dust (with about 30% of slaked lime incorporated therein). An existing road surface was cut out over a width of 3 m and three kinds of asphalt mixtures for skid road surface were each applied to the thus-cut road surface portion at a thickness of 4 cm in section to construct skid road surfaces of asphalt concrete.

The three kinds of the asphalt mixtures for skid road surface are of such compositions as shown in Table 1.

Table 2 shows the results of measurements made using a portable skid resistance tester after completion of the skid road surfaces. From the same table it is seen that there were obtained remarkably low skid resistance values in comparison with the value of a conventional pavement, which values little change even after the lapse of about a half year from summer to winter, thus ensuring a stable skid. Further, since the pavement furfaces obtained according to the present invention each have an uneven shape based on the coarse aggregate, a slight error in the amount of water sprinkled onto the road surface is also cancelled and thus the pavement surfaces could be used in the automobile running test without causing a hydroplaning phenomenon.

TABLE 1

| Item | Kind of Mixture | Mixture A | Mixture B | Mixture C |
|---|---|---|---|---|
| Aggregate (%) | Gravel 3 | 57 | — | — |
| | Gravel 2 | 19 | 38 | — |
| | Crushed stone No. 6 | — | — | 76 |
| | Crushed stone No. 7 | — | 36 | — |
| | Screenings | 10 | 11 | — |
| | Sand | 10 | 11 | 19 |
| | Stone dust | 4 | 4 | 5 |
| Amount of Asphalt (%) | | 4.3 | 5.1 | 4.5 |
| How to remove Asphalt Mortar | | water jet | water jet | shot blasting + sand blasting |
| Grinding | | ① 4 μm ② nylon pad | ① 4 μm, 10 μm ② nylon pad | ① 4 μm, 10 μm ② nylon pad |

Note) In the item "Grinding" ① represents the diameter of the abrasive powder used and ② represents an abrasive material.

TABLE 2

(Unit: BPN)

| Item | Kind of Pavement | Mixture A Road Surface | Mixture B Road Surface | Mixture C Road Surface | Existing Surface Course |
|---|---|---|---|---|---|
| Skid Resistance Value | Just after paving | 34 | 41 | 42 | 61 |
| | After the lapse of half a year | 34 | 39 | 44 | 58 |

What is claimed is:

1. A road surface specially designed to enhance skidding comprising an asphalt mixture containing a plurality of substantially spherical coarse aggregates, said aggregates having a randomly continuous shape on their upper surface.

2. A road surface in accordance with claim 1 wherein said coarse aggregate is natural gravel.

3. A road surface in accordance with claim 1 wherein said exposed coarse aggregate surface is substantially free of an asphalt coating.

4. A road surface in accordance in accordance with claim 1 wherein said coarse aggregate is characterized by a hardness of 6% or less, based upon abrasion loss, as measured by a Dobal tester.

5. A road surface in accordance with claim 4 wherein said hardness is 3% or less.

6. A surface in accordance with claim 1 wherein said coarse aggregate has an indoor PSV of 45 BPN or less, as measured by an aggregate accelerated abrasion test, according to the BS standard.

7. A surface in accordance with claim 6 wherein said indoor PSV test value before said aggregate accelerated abrasion test and said indoor PSV test value after said aggregate accelerated abrasion test differs by no more than 4 BPN units.

8. A road surface in accordance with claim 1 wherein said coarse aggregate skid resistance characteristic, as manifested by BPN units, measured by a portable skid resistance tester, varies by no more than 4 BPN after exposure to a 400 hour weathering test of alternating ultraviolet radiation and water sprinkling compared to its value prior to said weathering test.

9. A road surface in accordance with claim 1 wherein said coarse aggregate has a diameter of 5 mm to 20 mm.

10. A road surface in accordance with claim 1 wherein said coarse aggregate is present in an amount of between 50% and 90% by weight, based on the total weight of the asphalt mixture.

11. A road surface in accordance with claim 10 wherein said coarse aggregate is present in an amount of between 60% and 80% by weight.

12. A road surface in accordance with claim 1 including fine aggregates which comprise sand, present in a concentration of between 25% and 75% by weight, based on the total weight of said fine aggregates.

13. A road surface specially designed to enhance skidding comprising an asphalt mixture which includes substantially spherical course aggregates present in the concentration of between 50% and 90% by weight, based on the total weight of said asphalt mixture; fine aggregates including sand, present in a concentration of between 25% and 75% by weight, based on the total weight of said fine aggregates; stone dust; slaked lime; and asphalt.

14. A road surface in accordance with claim 13 wherein said coarse aggregates are present in a concentration of between 60% and 80%; said stone dust is present in a concentration of between 1% and 8%; said slaked lime is present in a concentration of between 1% and 3%, all said percentages being by weight, based on the total weight of said asphalt mixture, and wherein said asphalt component includes an elastomer, present in a concentration of 1% to 10% by weight, based on the total weight of the asphalt component.

15. A method of constructing a road surface designed to enhance skidding comprising removing an asphalt coating of a road surface and replacing with the road surface of claim 13.

16. A method in accordance with claim 15 wherein said step of removing said asphalt coating comprises heating and thereafter dislodging said asphalt coating.

17. A method in accordance with claim 15 wherein said step of removing said asphalt coating comprises spraying a gas oil or solvent over said asphalt coating whereby said asphalt coating is dissolved and removed.

18. A method in accordance with claim 15 wherein said step of removing said asphalt coating comprises subjecting said asphalt coating to a stream of water ejected at a pressure of at least 300 $kg/cm^2$.

19. A method in accordance with claim 15 wherein said step of removing said asphalt coating comprises subjecting said asphalt coating to blasting by steel shot, said shot selected from the group consisting of spherical steel having a diameter of 0.3 to 2.5 mm and steel having a dihedral angle.

20. A method in accordance with claim 15 wherein said step of removing said asphalt coating comprises subjecting said asphalt coating to blasting by sand selected from the group consisting of spherical sand having a diameter of 0.6 to 2.2 mm and sand having a dihedral angle.

* * * * *